US009359854B2

(12) United States Patent
Hughes et al.

(10) Patent No.: US 9,359,854 B2
(45) Date of Patent: Jun. 7, 2016

(54) WELLBORE TOOLS AND METHODS

(75) Inventors: John Hughes, Calgary (CA); Ryan Dwaine Rasmussen, Calgary (CA); James Wilburn Schmidt, Calgary (CA)

(73) Assignee: RESOURCE COMPLETION SYSTEMS INC., Calgary (CA)

( * ) Notice: Subject to any disclaimer, the term of this patent is extended or adjusted under 35 U.S.C. 154(b) by 309 days.

(21) Appl. No.: 13/469,509

(22) Filed: May 11, 2012

(65) Prior Publication Data

US 2013/0299200 A1 Nov. 14, 2013

(51) Int. Cl.

| | |
|---|---|
| ***E21B 23/06*** | (2006.01) |
| ***E21B 23/02*** | (2006.01) |
| ***E21B 34/14*** | (2006.01) |
| ***E21B 33/12*** | (2006.01) |
| ***E21B 34/08*** | (2006.01) |
| ***E21B 23/00*** | (2006.01) |
| ***E21B 33/124*** | (2006.01) |
| ***E21B 33/129*** | (2006.01) |

(52) U.S. Cl.

CPC ..... *E21B 33/12* (2013.01); *E21B 23/006* (2013.01); *E21B 33/124* (2013.01); *E21B 33/1291* (2013.01); *E21B 34/08* (2013.01)

(58) Field of Classification Search

CPC ..... E21B 23/06; E21B 23/02; E21B 33/124; E21B 33/12955; E21B 34/14

USPC ..... 166/332.1, 334.1, 334.4, 191

See application file for complete search history.

(56) References Cited

U.S. PATENT DOCUMENTS 4,312,406 A 1/1982 McLaurin et al.
4,344,651 A * 8/1982 Longacre et al. ..... 299/5
5,261,492 A * 11/1993 Duell et al. ..... 166/387
5,479,989 A * 1/1996 Shy et al. ..... 166/332.4
5,676,208 A * 10/1997 Finley ..... 166/278
6,003,834 A * 12/1999 Read ..... 251/30.01

(Continued)

FOREIGN PATENT DOCUMENTS

CA 2639341 3/2009
CA 2693676 7/2010

(Continued)

OTHER PUBLICATIONS

Wireline Tools and Equipment Catalog—Tools International Corporation, Jun. 1, 2008.

(Continued)

*Primary Examiner* — Kenneth L Thompson

(74) *Attorney, Agent, or Firm* — McDonnell Boehnen Hulbert & Berghoff LLP

(57) ABSTRACT

A straddle packer tool for setting against a constraining wall includes: a drag assembly with a locking mechanism for locking a position of the drag assembly relative to the constraining wall; a mandrel installed in and axially moveable through an inner bore of the drag assembly; and a packing element housing including a first annular packing element and a second annular packing element spaced from the first annular packing element, the packing element housing positioned between a stop shoulder on the mandrel and the drag assembly, the packing element being settable to expand the first annular packing element and the second annular packing element by compression between the drag assembly and the stop shoulder. A valve sub including a pressure actuated piston is also described and may be operated to open using the straddle packer tool.

64 Claims, 7 Drawing Sheets

(56) References Cited

U.S. PATENT DOCUMENTS

| | | | | |
|---|---|---|---|---|
| 6,024,173 | A | 2/2000 | Patel et al. | |
| 6,513,595 | B1 | 2/2003 | Freiheit et al. | |
| 7,472,746 | B2 * | 1/2009 | Maier | 166/129 |
| 7,556,102 | B2 | 7/2009 | Gomez | |
| 7,866,402 | B2 * | 1/2011 | Williamson, Jr. | 166/374 |
| 7,971,646 | B2 * | 7/2011 | Murray et al. | 166/332.4 |
| 8,267,178 | B1 * | 9/2012 | Sommers et al. | 166/334.4 |
| 8,783,370 | B2 * | 7/2014 | Ringgenberg et al. | 166/387 |
| 2007/0272411 | A1 | 11/2007 | Lopez de Cardenas et al. | |
| 2011/0308817 | A1 | 12/2011 | Ravensbergen | |
| 2012/0325466 | A1 * | 12/2012 | Themig | 166/255.2 |

FOREIGN PATENT DOCUMENTS

| | | |
|---|---|---|
| CA | 2713611 | 1/2011 |
| CA | 2738907 | 7/2011 |
| CA | 2766026 | 7/2011 |
| CA | 2788985 | 3/2013 |

OTHER PUBLICATIONS

2002 Flow Control Systems Catalog—Baker Oil Tools, Copyright 2002.

U.S. Appl. No. 13/857,230, filed Apr. 5, 2013 entitled "Wellbore Treatment Tool and Method"; 42 pages.

* cited by examiner

WELLBORE TOOLS AND METHODS

FIELD

The invention relates to wellbore tools and methods for wellbore completions and, in particular, for fluid control and injections.

BACKGROUND

Wellbore completion operations require tools for fluid control and injections. For example, packers are employed to control fluid flows and to isolate and direct fluid pressures. In addition or alternately, fluid delivery ports may be employed to direct injected fluid from delivery strings into particular areas of the formation.

SUMMARY

In accordance with a broad aspect of the present invention, there is provided a straddle packer tool comprising: a drag assembly including a tubular body defining an inner bore extending along the length of the tubular body and an outer facing surface carrying a locking mechanism for locking a position of the drag assembly relative to the constraining wall; a mandrel including a first end formed for connection to a tubular string and an opposite end, the tubular mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly, the packing element being settable to expand the first annular packing element and the second annular packing element by compression between the drag assembly and the stop shoulder.

Also provided is a method for pressure isolating an area along a wellbore wall in a wellbore, the method comprising: running into a wellbore with a straddle packer tool connected to a tubing string, the straddle packer tool including a drag assembly including a tubular body defining an inner bore extending along the length of the tubular body and an outer facing surface carrying a locking mechanism for locking a position of the drag assembly relative to the wellbore wall; a mandrel including a first end formed for connection to a tubular string and an opposite end, the tubular mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly; positioning the straddle packer tool with the first annular packing element and the second annular packing element straddling the area of the wellbore; and pulling the tubing string into tension to expand the first annular packing element and the second annular packing element by compression between the drag assembly and the stop shoulder to seal against the wellbore wall and pressure isolate the area between the first annular packing element and the second annular packing element.

There is further provided a wellbore treatment assembly comprising: a tubular string manipulatable from surface; a swivel connected to the tubular string, the swivel having a first end and a second end and configured to permit rotation between its ends; a straddle packer tool for setting against a constraining wall of the wellbore including: a drag assembly including a tubular body defining an inner bore extending along the length of the tubular body and an outer facing surface carrying a locking mechanism for locking a position of the drag assembly relative to the constraining wall; a mandrel including a first end connected for movement by the tubular string through the swivel and an opposite end, the tubular mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly, the packing element being settable to expand the first annular packing element and the second annular packing element by compression between the drag assembly and the stop shoulder.

According to another aspect of the invention, there is provided a wellbore valve sub comprising: a tubular wall including an upper end, a lower end, an inner bore extending between the upper end and the lower end and a outer surface; a port extending through the tubular wall providing fluid access between the inner bore and the outer surface; a valve piston installed in the tubular wall and moveable between a closed port position, wherein the closes the port and an open port position, wherein valve piston is retracted from the port; a first pressure communication path through the tubular wall to a first end of the valve piston, the first pressure communication path positioned between the port and the lower end; and a second pressure communication path to a second end of the valve piston, the second pressure communication path being positioned between the port and the upper end, the valve piston being moveable from the closed port position to the open port position by increasing the pressure in the first pressure communication path relative to the second pressure communication path to establish a pressure differential between the first end and the second end to move the valve piston upwardly toward the upper end.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

A straddle packer tool, a sliding sleeve valve and assemblies and methods for wellbore operations have been invented.

Figure 1:
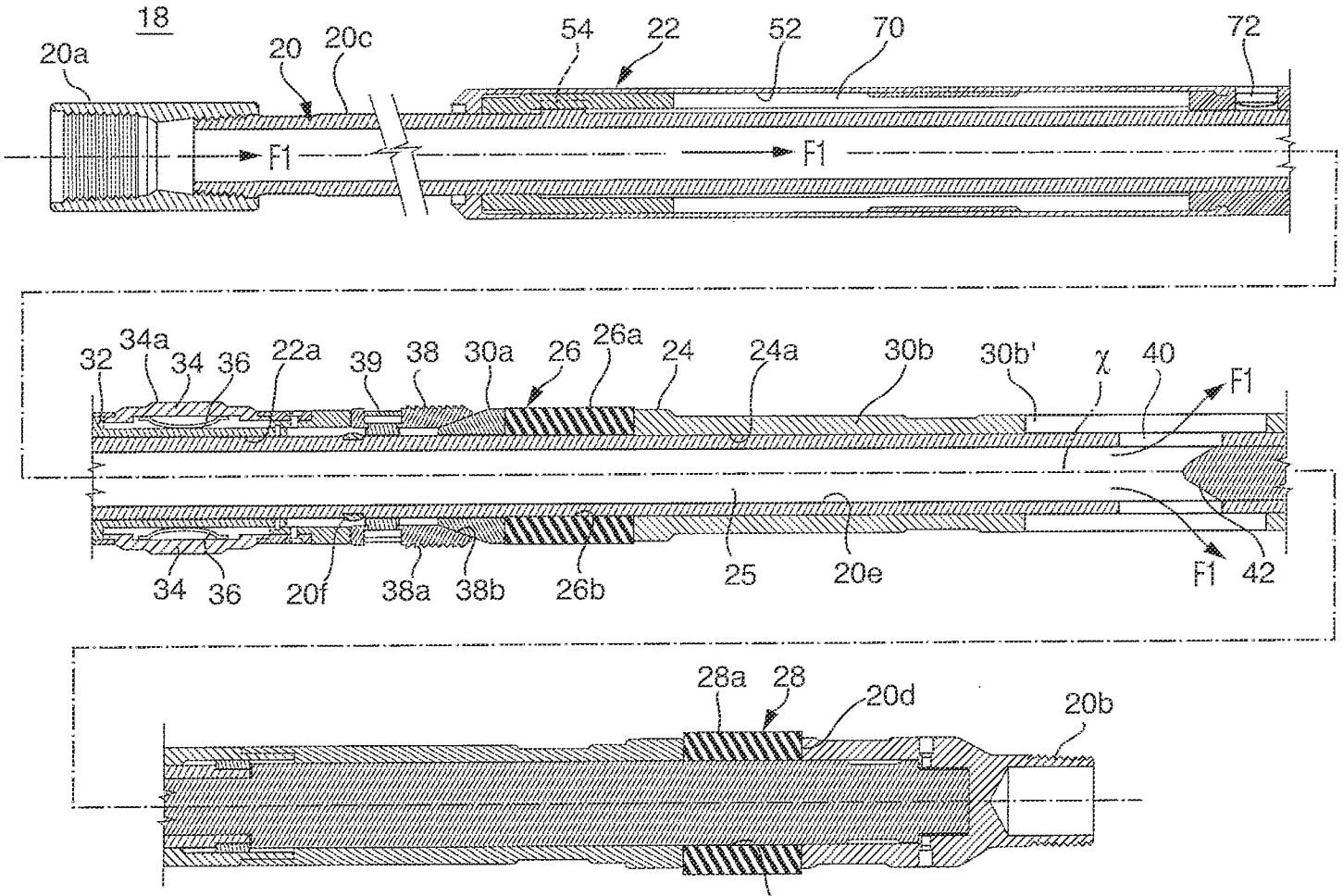
FIG. 1 is an enlarged sectional view of a straddle packer tool.

With reference to FIGS. 1 and 2, one embodiment of a straddle packer tool 18 is shown. The straddle packer tool includes a tubular mandrel 20 including an upper end 20*a*, a lower end 20*b* and an outer surface 20*c* extending therebetween.

The straddle packer tool can be incorporated in a string by connection of string 10 directly, or via string components 14*a*, at end 20*a*. Possibly a lower portion of the string and/or further components 14*b* may be connected at end 20*b*. The ends may therefore be formed for connection into a string in various ways. For example, they can be threaded, as shown. Alternately, the ends may have other forms or structures to permit alternate forms of string connection.

Figure 2A:
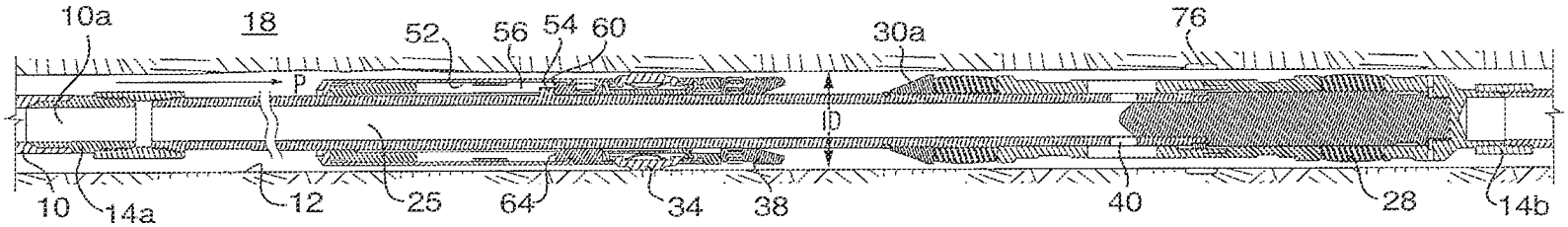
FIGS. 2A to 2I, sometimes referred to herein generally as FIG. 2, are sectional views of a straddle packer tool in operation in a well.
Figure 2B:
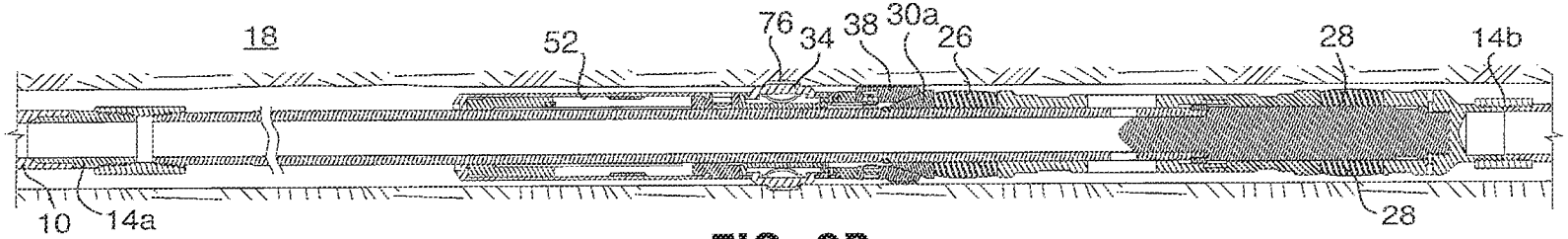

The straddle packer tool further includes a drag assembly 22 and a packer element housing 24. Each of drag assembly 22 and packer element housing 24 have a tubular form and have an inner facing surface 22*a*, 24*a* defining an inner bore therethrough. Each of drag assembly 22 and packer element housing 24 are mounted over tubular mandrel 20 with the mandrel passing through their inner bores. Each of drag assembly 22 and packer element housing 24 are axially moveable along at least a portion of the length of the tubular mandrel and are configurable between a packing element unset position (FIG. 2A) and a packing element set position (FIGS. 1 and 2D).

Packer element housing 24 includes an upper packing element 26 and a lower packing element 28, spaced from the upper packing element. Each of the packing elements are annularly formed and encircle mandrel 20. Packer element housing 24 further includes element compression collars 30*a*, 30*b*, these collars also being annularly formed to encircle mandrel 20. In this packer, packing elements 26, 28 become set to create a seal in the wellbore by compression. For example, in the packing element unset position (FIG. 2A) packer element housing 24 is in a neutral, uncompressed position with packing elements 26, 28 retracted, for example, to an outer diameter less than the inner diameter ID of any bore, shown here as constraining wall 12, in which packer tool 18 is positioned. However, when in the packing element set position (FIGS. 1 and 2D), packer element housing 24 is in a compressed condition with the packing elements extruded radially outwardly. For example, when in use and in a set position, elements 26, 28 have an outer diameter pressed against the constraining wall and therefore equal to the inner diameter of any bore in which the packer tool is positioned. Packer tool 18 may be returned to the packing element unset position (FIG. 2G to 2I) by releasing the compressive force on the packing element housing 24, after which the packing elements will return to a retracted position.

Packing elements 26, 28 are formed of deformable, elastomeric materials such as rubber or other polymers and upon application of compressive forces against the sides thereof, they can be squeezed radially out. In use, when the packing elements are squeezed out, FIG. 2D, their outer facing surfaces 26*a*, 28*a* are driven into contact with a constraining wall 12 of the bore in which the straddle packer tool is positioned. At the same time, the backsides 26*b*, 28*b* of the packing elements become pressed against the mandrel. As such, elements form a pair of spaced apart seals in the annular area between the mandrel and a constraining wall such that fluids are prevented from passing through the annular area therepast. Compression collars 30*a*, 30*b* or other walls, such as shoulder 20*d* of mandrel, are formed of rigid materials such as steel and transfer compressive forces to the packing elements. Compression collars 30*a*, 30*b* and mandrel at shoulder 20*d* also may have a radial thickness selected to resist problematic lateral extrusion of the packing elements, instead directing elements 26, 28 radially outwardly as they are compressed. In this illustrated embodiment, compression collar 30*a* is positioned at an end of the packing element housing adjacent upper packing element 26 and compression collar 30*b* is positioned between elements 26, 28. While a compression collar could be positioned at the end of the packing element housing on the opposite side of element 28 from collar 30*b*, in this embodiment, lower packing element 28 is instead directly adjacent shoulder 20*d* on mandrel and that shoulder works with collars 30*a*, 30*b* to effect compression and setting of packing elements 26, 28.

The force to achieve compression of elements 26, 28 may be as a result of pushing one of the parts, shoulder 20*d* or 30*a*, toward the other of the parts, while the other part is held stationary. Of course, the other part may also have a pushing force applied thereto, but as the straddle packer tool is intended for downhole use, routinely force is applied from surface by manipulation of the tubing string into which the straddle packer tool is connected, while a part of the tool is held steady. For example, if straddle packer tool 18 is installed with end 20*a* connected to a tubing string 10, directly or through components 14, with the string extending uphole toward surface, force can be applied by lowering or pulling on the string. In this embodiment, as shown, the packing elements of the straddle packer tool can be compressed by pulling on the tubing string attached at end 20*a*, while collar 30*a* is held stationary. This straddle packer tool, then may be tension set and can be deployed using string 10 such as of coiled tubing or jointed tubing. The packer may be set and released using tubing reciprocation: pull the string in tension to set the packer and put weight into the string to release the packer.

Drag assembly 22 acts as an anchor for permitting compression of housing 24. Drag assembly 22 is employed to create a fixed stop against which the packing element housing can be compressed. Drag assembly 22 works with mandrel 20 to effect compression.

As noted above, drag assembly 22 has a tubular form and is sleeved over and axially moveable along mandrel 20. Drag assembly 22 includes a locking mechanism for locking its position relative to a constraining wall 12 in which packer tool 18 is employed. For example, drag assembly 22 may include an annular body 32 and a drag mechanism carried by the annular body, which is formed to engage constraining wall 12. Drag mechanism may include for example, blocks 34 that are biased radially outwardly from annular body 32, for example as by springs 36. Blocks 34 each include an outer engaging face 34*a* formed to frictionally engage, and provide resistance to movement of its block along, wall 12 surface. While drag blocks 34 can be forced to move across the wall surface, the blocks frictionally engage against wall 12 such that a resistance force is generated by movement of blocks across the surface. This resistance is transferred to body 32 such that the movement of drag assembly 22 relative to the constraining wall 12 is also resisted such that if packer tool 18 is moved through a bore defined by wall 12, the drag assembly can only be moved along by applying a force to it, for example by pushing or pulling the mandrel against the drag assembly. When in a bore, for example, where drag blocks engage against a constraining wall of the bore, the mandrel can be moved through drag assembly 22, while the drag assembly remains stationary, until the mandrel butts against the drag assembly. Thereafter, the drag assembly can be moved along with the mandrel. If the mandrel is stopped and moved in an opposite direction, mandrel 20 moves through drag assembly 22, with the drag assembly remaining stationary, until the mandrel applies a force against the drag assembly to move it in that opposite direction. Mandrel 20 therefore may include a shoulder or other engagement mechanism to apply force to the drag assembly, for example shoulder 20*d* of mandrel can apply a force through housing 24 to effect movement of drag assembly 22.

As noted above, drag assembly 22 can be locked into a position relative to packing element housing 24 while mandrel 20 is pulled up through these members until housing 24 and, in particular, elements 26, 28 are compressed between the drag assembly and shoulder 20*d*. While the drag blocks 34 may be selected to lock drag assembly 22 in a position for this purpose, a stronger locking mechanism may be required to lock the position of drag assembly. Thus, in this embodiment, drag assembly 22 further includes slips 38 carried on body 32. Slips 38 are normally retracted but can be driven radially out into engagement with constraining wall 12 to lock drag assembly 22 in a selected position, when it is appropriate to do so. Slips 38 include a keeper 39 that hold them on body 32. Slips 38 also include on their outer facing sides teeth 38*a*, such as whickers, selected to bite into the material of the constraining wall and may be selected with consideration as to the hardness and material of the constraining wall, be it a steel surface such as of casing or liner or an open hole surface such as an exposed wellbore wall. Drag assembly 22 further includes a mechanism for driving the slips to expand radially out. The slips may be driven by employing various mechanisms. In this embodiment, the driving mechanism operates in response to compressive force applied to the drag assembly. For example, in the illustrated embodiment, expansion force is driven by frustoconical guide surfaces 38*b* formed on the backsides of the slips that function in cooperation with a compressive force applied along long axis x of the packing tool. In this embodiment, the compressive force is applied from mandrel 20, through housing 24 to the slips, while drag assembly 22 is maintained in a position fixed against axial movement. Since drag assembly 22 cannot move, any compressive force applied acts to move slips 38 out due to the form of surfaces 38*b*.

In this embodiment, it is compression collar 30*a* that bears against the slips. Slips 38 are in a position to be lifted by collar 30*a*, when the end of the collar is urged beneath the slips. For example, when a compressive force is exerted by mandrel 20 against housing 24, collar 30*a* passes beneath the slips 38 and acts to move the slips radially outwardly into contact with constraining wall 12. As will be appreciated, the outer diameter of the collar 30*a* and the thickness of slips 36 where they overlap must be selected with consideration as to the distance between tool 18 and constraining surface 12 when in use.

To more efficiently and stably translate compressive axial motion into radially directed force to drive the slips radially outwardly, end 30*a*' of the collar may also be shaped frustoconically, as shown, to have an angled face substantially similar to that of frustoconical guide surface 38*b* of the slips.

In this embodiment, drag blocks 34 provide resistance to permit slips 38 to become engaged, while slips 38 provide the locking effect necessary for setting the packing elements. In particular, drag blocks 34 through engagement with constraining wall, provide an initial locking effect to hold the drag assembly stationary such that compressive force can be applied to urge slips 38 outwardly and, thereafter, once slips 38 are firmly engaged to hold the drag assembly more firmly in a locked position, further compressive force can be applied to compress and extrude packing elements 26, 28 into a set position.

While the straddle packer tool 18 can be employed for creating a seal in a well, in this embodiment, straddle packer tool 18 can further be employed to provide fluid communication therethrough to a port 40 between elements 26, 28. Thus, while mandrel 20 may have a solid form, in this embodiment mandrel includes an inner bore 25 therethrough defined by an inner facing surface 20*e* of the mandrel. The inner bore extends from upper end 20*a* toward the lower end to port 40. Port 40 opens to outer surface 20*c* of the mandrel and an opening 30*b*' in collar 30*b* permits fluid flow (arrows F1) from the inner bore to an annular area between elements 26, 28. In this embodiment, an end wall 42 stops inner bore 25 at a position just below port 40. It is noted that end wall 42 in this embodiment is formed as a diverter, with an angled surface leading to port 40, to direct fluid laterally from the inner bore out through port 40. In some embodiments, the inner bore defined by inner facing surface 20*e* may extend from end 20*a* to end 20*b* of the mandrel to provide a flow path fully therethrough.

When the illustrated straddle packer tool 18 is connected into a string, bore 25 of the straddle packer tool is placed in communication with a bore 10*a* of the string such that fluids passing through the string and string components 14 can enter the bore and can pass therethrough to and through port 40. The straddle packer tool allows the passage of fluid therethrough to a position in the string between packing elements 26, 28.

While flow is shown outwardly through port 40 it is to be understood that flow can be reversed to also flow in through port 40 from outer surface 20*c* to bore 25, as desired. There is no one-way flow restrictor in the passage and, therefore, fluid can flow in either direction depending on fluid pressure differentials.

Drag assembly 22 and packing element housing 24 are sleeved over and axially movable along tubular mandrel 20 and the parts are intended to remain as such during operation such that they cannot fully separate from the mandrel. However, as noted, the drag assembly and the packing element housing are axially moveable relative to the mandrel between the packing element unset position, wherein the parts are neutral and uncompressed and the packing element set position, wherein the parts are compressed causing the slips and the packing elements to be driven outwardly into contact with the constraining wall.

While housing 24 could be fully moveable along mandrel, a shoulder 20*f* may be provided to limit the movement of housing 24 toward end 20*a*. This shoulder may prevent the housing from accidentally migrating up to set under slips, for example during run in. Also, since the wedging effect of collar 30*a* under slips 38 may be significant in a set packer, collar 30*a* may not be easily moved from under the slips and shoulder 20*f* may be useful to impact against housing 24 when the packer is unset to urge the collar out from under the slips.

The straddle packer tool may be reciprocated between the unset and the set positions by movement of the mandrel relative to the drag assembly. For example, movement of the mandrel to push shoulder 20*d* away from drag assembly 22 causes the packing elements and the slips to become unset, while movement of the mandrel to move shoulder 20*d* toward drag assembly 22 causes the mandrel to be pulled up through drag assembly 22, movement of the drag assembly is resisted by action of drag blocks 34 and eventually housing 24 becomes sandwiched between shoulder 20*d* and drag assembly 22 and a compressive force is applied to the packing elements and 38 slips, causing them to set. However, it may occur that the drag assembly which normally has movement resisted by action of drag blocks may accidentally cause the packer to set. For example, whenever the packer is moved up through a wellbore toward surface, the packer could set. Thus, in one embodiment straddle packer tool 18 includes a position indexing mechanism employed to direct the movement of the drag assembly relative to the tubular mandrel, between a position where it will operate to drive the packing elements to set and positions in which drag assembly 22 is inactive and inoperative to drive the packing elements to set. The position indexing mechanism may, for example, include J-slot indexing mechanism including a slot 52 and a key 54. The slot and the key may be positioned between the drag assembly and the mandrel, for example in the gap between outer facing surface 20*c* and inner facing surface 22*a*. In this embodiment, slot 52 is formed on the inner facing surface of the drag assembly body and key 54 is installed on the mandrel, but this orientation can be reversed if desired. The key is sometimes termed a guide pin or J-pin since it rides along within the J-slot.

The position indexing mechanism guides the axial movement between the drag assembly and the mandrel. For example, the axial length of slot 52 between its ends and the relative position of the key may be selected to allow sufficient axial movement of the sleeve and the mandrel to allow the packer to be set and unset and slot can further be laid out to permit axial movement of the sleeve and the tubular member to be positively stopped in an intermediate inactive, unsettable position, wherein setting of the packer is prevented in spite of movement of the mandrel which would otherwise cause the packer to set. This can be achieved, for example, by forming the slot as a J-type slot.

In one embodiment a continuous J-type slot may be provided about the circumference of tool 18 so that the mandrel can be continuously cycled between active positions and inactive positions relative to the drag assembly. One possible layout for a J-type slot 52 is shown in FIG. 3.

The key reacts with the side and end walls of J-slot 52 to provide a guiding function to move mandrel 20 axially and rotationally relative to drag assembly 22 and permits the drag assembly and the mandrel to be indexed into the unset, uncompressed and the set, compressed positions and also positively into at least one intermediate unset position. While the slot geometry can vary, in this illustrated embodiment, the J-slot includes four stop areas and adjoining angled slot sections therebetween. The four stop areas include: end wall 60, end area 62, end wall 64 and end wall 66, which is herein illustrated as separated into two parts, since this J-slot is continuous and therefore extends about the circumference of the tool. Each stop area has an angled slot section extending away toward the next stop area: angled slot section 61 leads from end wall 60 to stop area 62; angled slot section 63 leads from stop area 62 to end wall 64; angled slot section 65 leads from end wall 64 to end wall 66; and, since the J-slot is continuous, angled slot section 67 leads from end wall 66 back to end wall 60. The slot geometry allows the mandrel to be moved axially within the drag assembly according to the linear spacing between the various end walls. Bearing in mind that the drag assembly is selected to resist movement during use, the angled slot sections cause axial movement of the mandrel within the drag assembly to be converted into rotational movement to move the mandrel from stop area to stop area along the slot, as the tool is reciprocated. In particular, any pushing or pulling movement of the straddle packer tool acting axially through end 20*a* will cause key 54 to ride through the slot and eventually land against an end wall in a stop area. Thereafter, any pushing or pulling movement in an opposite direction causes key to move axially away from the previous end wall and engage an axially aligned angled slot section. As the angled slot section is contacted by key 54, an indexing rotation will be applied to the tubular mandrel and the key will move until stopped against the next end wall in the slot. The key can only advance to the next position, if the pushing or pulling movement is again reversed. The angled sections are formed such that the key is always forced to move in a predefined path, and reverse movement cannot be readily achieved. In the illustrated embodiment, the end walls are separated by 90° and so the parts move about 360° when passing from a starting end wall position, through all the other positions and back to that position.

Figure 2C:
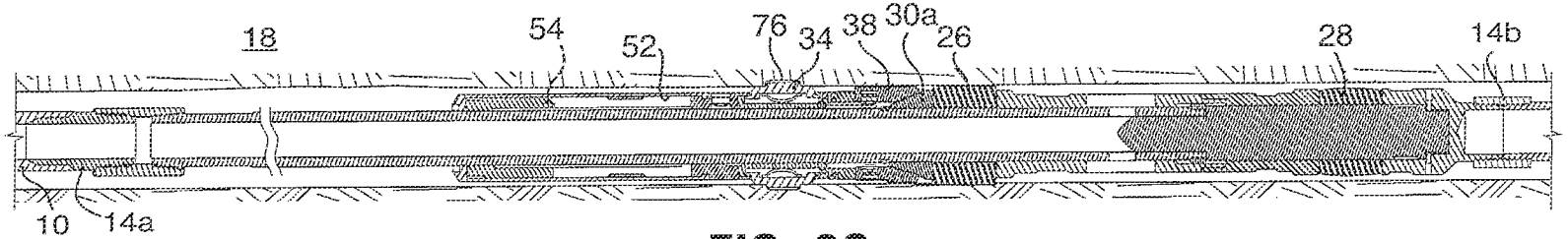
Figure 2D:
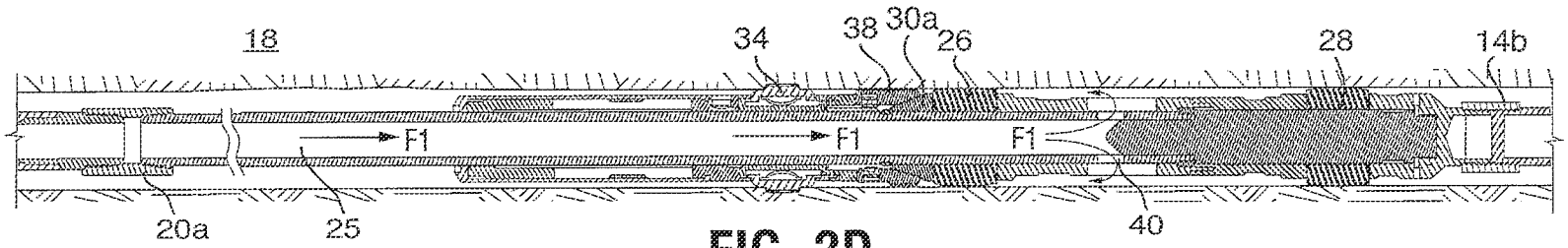
Figure 2E:
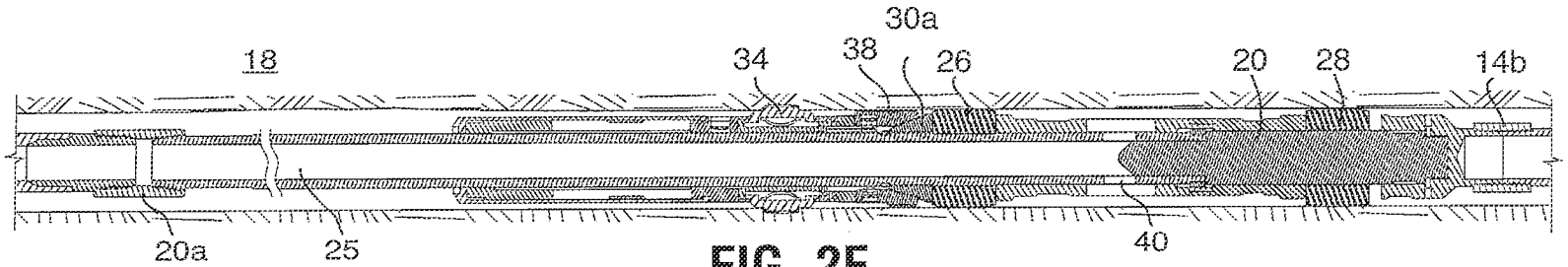
Figure 2F:
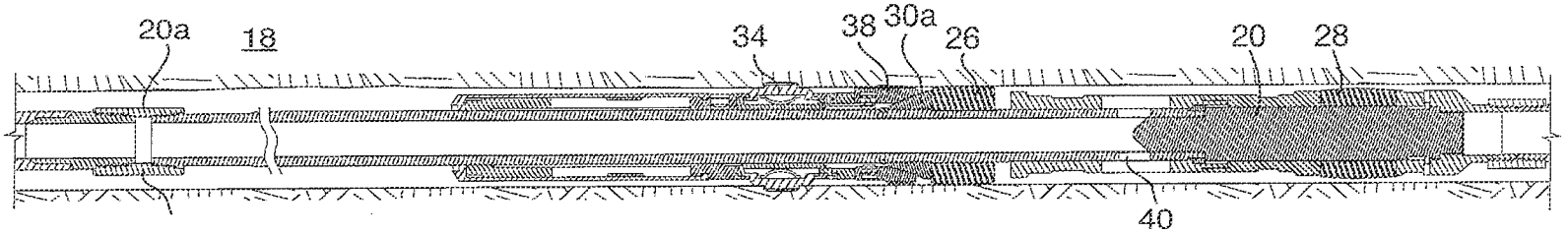
Figure 2G:
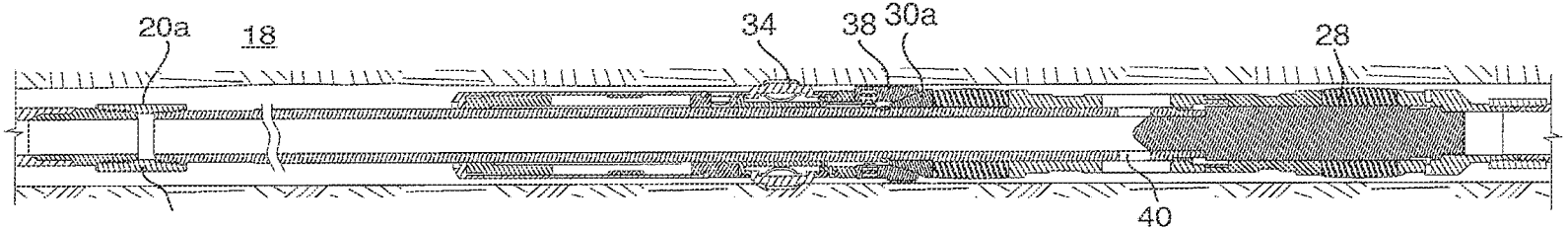
Figure 2H:
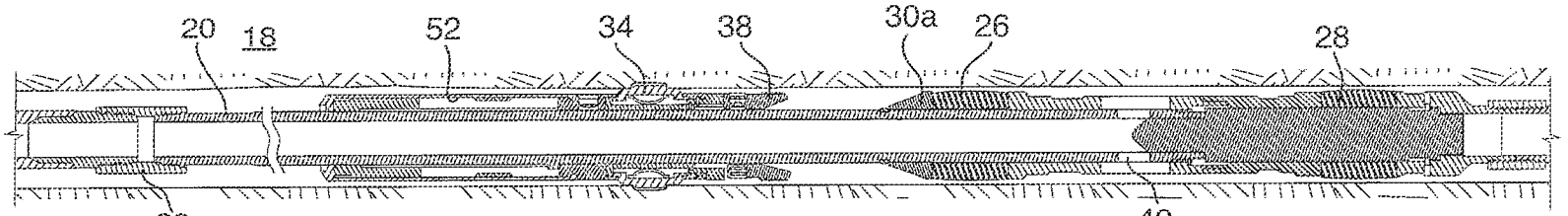
Figure 2I:
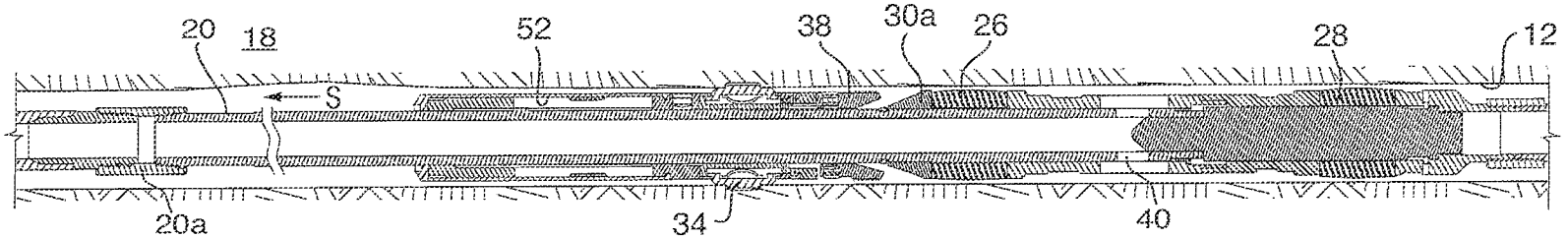
Figure 3:
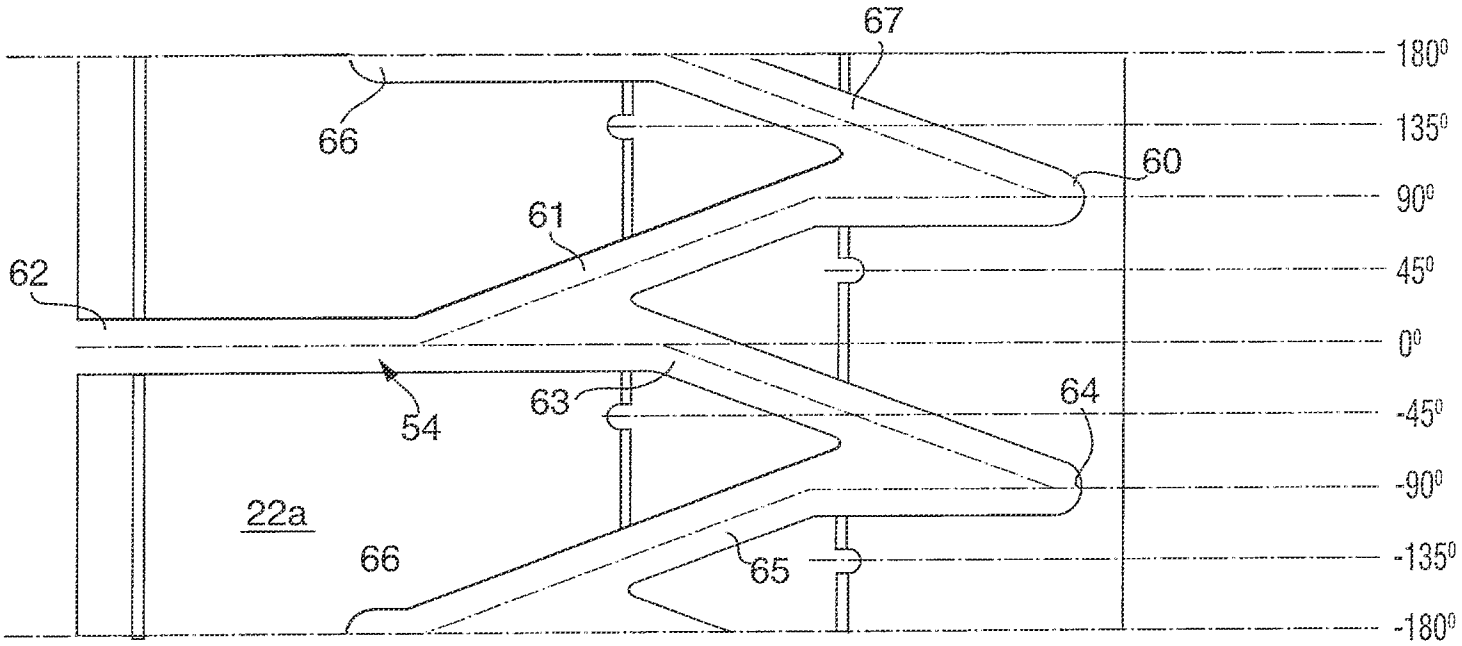
FIG. 3 is an enlarged plan layout of a J-slot geometry useful in the straddle packer of FIG. 2.

The slot geometry is shown in FIG. 3 and the movement of key 54 through slot 52 can be further understood by reference to FIG. 2, which show the packer in use in a wellbore. FIG. 2A shows the packer in a run in condition being moved through the bore within constraining walls 12. In this condition, string 10 is applying a push force, arrow P, from above and mandrel 20 is pushed through the drag assembly, which is resisting movement by normal engagement of blocks 34 against wall 12. This movement sets key 54 against end wall 60. Drag assembly 22 is moved along with the mandrel but rides along close to end 20*a*, in a position established by J-slot, possibly with the additional support of stop walls acting between the mandrel and the assembly. There is no compressive force on housing 24 and, therefore, elements 26, 28 remain retracted. Elements 26, 28 may be selected to have an outer diameter in the relaxed state that is less than the inner diameter ID of wall 12 such that they do not contact the wall as the packer is moved along. This mitigates stuck conditions and avoids problematic packer wear. Port 40 is open and, therefore, fluid can be circulated through bore 25 and port 40 and out into the annulus, if desired.

When the packer is positioned in a selected area of the well, the packer can be prepped for setting. String 10 is pulled into tension, also called "picked up", which draws mandrel 20 toward surface. As shown in FIG. 2B, when mandrel 20 is pulled toward surface, drag assembly 22 remains in place due to the engagement of blocks 34 with wall 12. This movement therefore draws mandrel 20 through the drag assembly and key 54 rides along slot 52 toward stop area 62, as directed by angled slot section 61. Mandrel 20 thus moves into a position with housing 24, and in particular collar 30*a*, close to drag assembly 22 and as drag assembly 22 is held by drag blocks 34, continued movement of mandrel 20 drives collar 30*a* under slips 38 so that they move outwardly into engagement with wall 12. This further ensures that drag assembly cannot move relative to the constraining wall.

When it is desirable to set the packer, mandrel 20 may be further pulled uphole, as shown in FIG. 2C, and this movement draws shoulder 20*d* against housing 24, while the housing is held at its opposite end by collar 30*a* wedged under drag assembly 22. Thus, this compresses housing 24 and causes both elements 26, 28 to extrude outwardly against wall 12 (FIG. 2D). During this movement of mandrel 20 through the drag assembly, key 54 continues along slot 52 until it reaches a position in stop area 62. Stop area 62 may, in fact, be formed with sufficient space such that key 54 never stops against a wall during normal use such that the compressive load applied into elements 26, 28 is not limited by any interaction of key and slot.

In this position, the space between elements 26, 28 is isolated from the annulus adjacent ends 20*a*, 20*b*. Port 40 is open and fluid can be injected, arrows F1, through bore 25 and port 40 out into the annulus, if desired. Because of the seals provided by elements 26, 28 considerable pressures can be achieved in the space and such fluid can be directed out to effect the walls or to treat the formation accessed behind the walls.

When it is desired to unset the packer, the weight on string 10 can be increased (also called "setting down") such that mandrel 20 is pushed through the drag assembly. Initially, the mandrel's movement will remove shoulder 20*d* from its compressing position against element 28, which allows that packing element to relax and retract out of a sealing position (FIG. 2E). Thereafter, as the mandrel is further set down, the remaining components of housing 24, including element 26, will become uncompressed and relax (FIG. 2F). Eventually, mandrel 20 is moved sufficiently to remove collar 30*a* from under slips 38 such that they can be retracted from engagement with wall 12 (FIG. 2H). Since the wedging effect of collar 30*a* under slips 38 may be significant, collar 30*a* may not be easily moved from under the slips and shoulder 20*f* may be useful to impact against housing 24 as the packer is being unset (FIG. 2G). During this movement, key 54 rides along the slot, as directed by angled slot section 63, until it is set against end wall 64 (FIG. 2H).

At this point, work at this area is done and the packer can be moved up or down through the wellbore. If it is desired to move further down the wellbore, the packer can remain in the position shown in FIG. 2H and the string and mandrel 20 can be pushed down, with drag assembly 20 dragged along with the mandrel.

If, however, packer 18 is to be pulled up through the wellbore, the string will then be picked up drawing mandrel 20 back up through drag assembly 22 (as the assembly's movement is resisted by blocks 34). Without any movement guide, it would be appreciated that this movement would likely create an effect as shown in FIGS. 2B to 2D wherein the packer would become compressed and set. However, J-slot 52 allows the packer to be pulled uphole without setting by providing an intermediate position in slot 52: at end wall 66. Thus, as the mandrel is pulled up through drag assembly 22, key 54 rides along the slot and, as directed by angled slot section 65, until it is set against end wall 66 (FIG. 2I). The orientation of slot 52 and key 54 provides that when the key is at end wall 66, collar 30*a* remains spaced from slips 38 such that the packer cannot set. The packer can then be moved uphole, towards surface (arrow S), with the string pulling the mandrel uphole and with drag assembly 20 dragged along with the mandrel by engagement of key 54 against wall 66.

After positioning the packer in a configuration as shown in FIG. 2I with the housing maintained away from slips 38, it may be desired to reset the packer. To do this, the process of FIGS. 2A to 2D is repeated. For example, the mandrel is pushed down through drag assembly 22 and key 54 rides along the slot, as directed by angled slot section 67, from end wall 66 back until it is set against end wall 60. Thereafter, the mandrel can be pulled back up toward end wall 62 after which the packer can be set.

If debris accumulates above the packer, it may be circulated off.

It will be appreciated from the foregoing description, that reciprocation of the string is necessary to shift the packer between the set and the unset positions. The movement of mandrel 20 within housing should be easy and the operations of the presently illustrated packer rely on the full rotation of the mandrel in the drag assembly. Excessive friction between the packer mandrel and the drag assembly and/or the string may cause the drag assembly to rotate with the mandrel, preventing the packer from setting or releasing. Thus, swivels may be provided between string 10 and mandrel 20. A swivel may be provided in string components 14*a* at upper end 20*a* of the mandrel where it connects to string. If the string extends from both ends of the mandrel or string components 14*b* may create resistance to the free rotation of mandrel, a swivel may also be incorporated in string components 14*b* at end 20*b* of the mandrel. Swivels reduce the force required to rotate the mandrel during string reciprocation.

In addition or alternately, the space in which J-slot 52 operates may be protected from infiltration of debris. For example, J-slot 52 may be in a protected chamber 70. The chamber may be pressure balanced with the area around the tool, but may include a screen 72 that permits pressure communication between the chamber and the exterior of the tool to avoid a pressure lock, but excludes debris from infiltration into the chamber. Seals 74 such as wiper seals may be provided, if desired, to further protect against infiltration of debris.

The packer has features that reduce the chances of getting stuck in the well, such as the relaxed condition of elements 26, 28 out of contact with the wellbore wall while running through the well and the ability to circulate through bore 25 and port 40. However, components 14 may include a tension or hydraulic release to permit detachment of the straddle packer tool from string 10, if necessary. Components 14*a* may further include a normally closed, bypass circulation valve above tool 18 to permit fluid communication from string 10 and fluid circulation to remove of debris from above the tool when necessary. The bypass valve may be closed when in tension and when in compression but opened in neutral (i.e. at a position between tension and compression), so the open/closed condition of the valve can be readily known and controlled and the valve is not open when the straddle packer is set, since in the set condition, fluids are often required to be injected between the set packing elements.

To facilitate positioning and setting of the packer, one or more landing locator profiles 76 may be provided in the wellbore wall 12 into which blocks may land when/where it is desired to set a packer. The locator profiles may be cylindrical areas of larger diameter relative to the normal diameter ID of the wellbore wall. Locator profiles 76 may have an axial length at least as long as the axial length of blocks 34 such that the blocks can expand into the locator profiles, when they are aligned with them. The locator profiles may be a depth such that extra force is required for a block to ride out of a locator profile than what is required to move the block along the wellbore wall. They can ride out of the locator profiles but extra force is required to do so. This provides that (i) drag assembly 22 may be more firmly held in position when blocks are located in locator profiles 76, (ii) the depth of the packer in the wellbore may be determined by monitoring string weight and noting the number of locator profiles through which the packer has passed, and (iii) locator profiles 76 may used to ensure proper positioning of the packer in the well by positioning a profile adjacent a position in the well in which it is desired to set the packer. For example, the packer may be intended to straddle a selected area in the wellbore and locator profile 76 may be axially spaced from the port with considerations as to the compressed distance between the lower element 28 and drag blocks 34 such that when the drag blocks are located in the associated locator profile and the packing elements, including lower element 28, straddle the port. If using locator profiles, they may be selected to have an axial length greater than normal tubing discontinuities, such as casing connections, J-spaces, etc., in the wellbore, such that it is possible to identify the effect of the profiles 76 over passing into/through other discontinuities.

The packer may be used to isolate a portion of the well and with the injection port 40, may be used to both isolate and pressure effect an area along the wellbore. For example, packer may be employed to straddle perforations, burst disks or shiftable sleeves on a liner such as casing in a cemented or an open hole application. The packer may be employed to pressure effect the straddled component (i.e. burst the disk, hydraulically open the sleeve, etc.) and/or to pressure effect the formation accessed at that area of the wellbore (i.e. to pump fluid through port 40 into the formation).

For example, the packer can be employed wherein constraining wall 12 is a liner with perforations formed therethrough. The packer can be positioned with elements 26, 28 straddling the perforations in the wellbore liner and stimulation fluid can be pumped down the string, through bore 25 and diverted out through port 40 into the annular area between the packer and the liner. Elements 26, 28, being set above and below the perforations, seal the packer against the liner such that stimulation fluid is forced out through the perforations into the formation.

As another example, straddle packer 18 may be set across a burst disk in a liner. Pressure applied through the packer can be used to rupture the burst disk and open communication with the formation. Stimulation fluid can then be pumped through the port opened by bursting the disk and into the formation.

Figure 4:
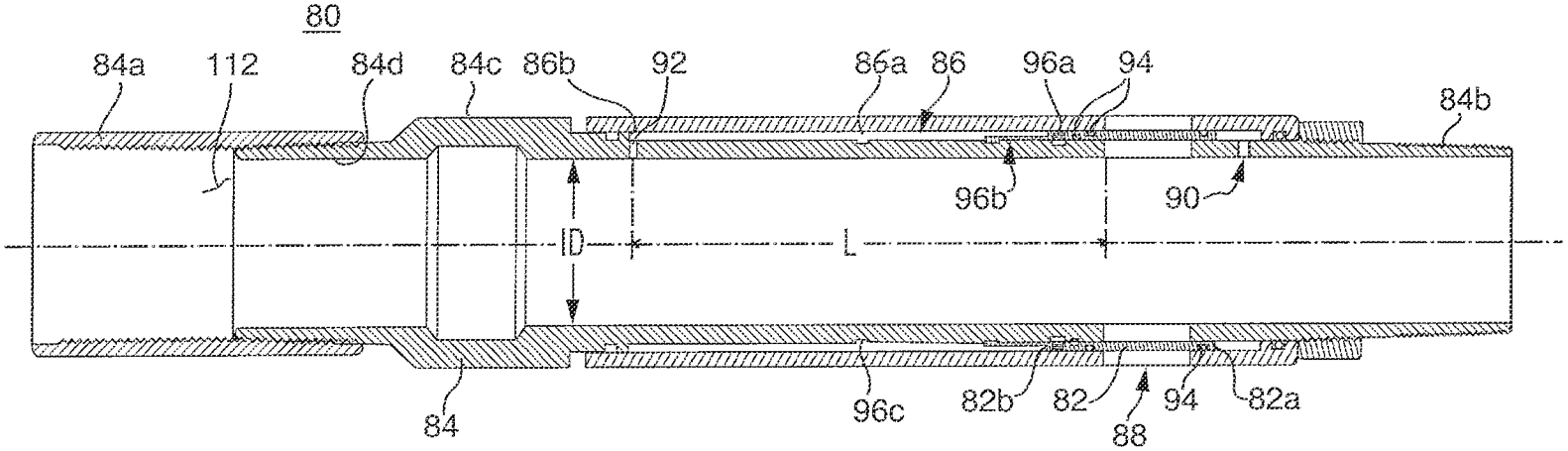
FIG. 4 is a sectional view along a long axis of a wellbore sliding sleeve valve.

Packer 18 can also be employed to open a hydraulically shifted wellbore valve, such as one having a piston such as a sleeve or poppet and possibly thereafter to inject fluid into the formation accessed behind the wellbore valve. While many such wellbore valves may be employed, one particularly useful valve sub 80 is shown in FIG. 4.

The valve sub 80 includes a hydraulically driven piston member, which herein is a sleeve 82 but may take other forms such as non-cylindrical sleeves, poppets, pocket pistons, etc, installed in a tubular wall 84. The sleeve may be installed such that a pressure differential can be established across the sleeve, between its ends 82*a*, 82*b*, and it can be moved as a piston. The sleeve, for example, may be installed in the wall with a pressure communication path accessing one end 82*a* of the sleeve and another, separate pressure communication path accessing the other end 82*b* of the sleeve.

Sleeve 82 can be positioned in wall 84 to be shifted up towards an upper end 84*a* of the sub to open, rather than down. Stated another way, valve sub 80 also may be constructed such that the pressure differential across the sleeve may be established with the high pressure source to be communicated below the sleeve and with a space above the sleeve into which it can move. This upward movement is useful as the liner may sometimes be fully closed below the sleeve, for example, the valve may be incorporated in a string with upper end 84*a* connected to an upper end portion and its lower end connected to a lower distal tubing string portion ending in a toe and the entire lower distal string portion from the valve to the toe may be closed and pressure tight. To shift a sleeve down, fluid must be displaced and a fully closed string may not be able to accommodate such displacement unless a conductivity path is opened from the string below (i.e. by cutting or otherwise opening a port through the string wall). Thus, by providing a shift-up to open valve, the valve can be employed and opened even when the string is fully closed below and close to the bottom of the string, as fluid displacement necessary to open the sleeve can be accommodated above the sleeve, for example if necessary, at surface.

In one embodiment, for example, tubular wall 84 can include an upper end 84*a* and a lower end 84*b*. The tubular wall may be formed for connection into a string, such as by forming ends 84*a*, 84*b* as threaded pins or boxes. The tubular wall has an outer surface 84*c* and an inner facing surface 84*d* which defines therewithin a bore 112.

Wall 84 includes chamber 86 formed therein between outer surface 84*c* and inner facing surface 84*d* and sleeve 82 is positioned in the chamber. Chamber 86 is formed such that sleeve can slide axially in chamber, except as limited by releasable locking structures if any. Since in this embodiment, the sleeve has cylindrical structure, chamber 86 herein has an annular form following the circumference of the tubular wall.

A formation communication port 88 extends through wall 84 passing through annular chamber 86 and port 88 provides fluid communication between bore 112 and outer surface 84*c*, which is placeable in communication with a formation when the sub is installed in a string and the string is installed in a wellbore. Formation communication port 88 is actually two openings, one through the wall thickness between inner facing surface 84*d* and chamber 86 and the other through the wall thickness between chamber 86 and the outer surface, but these two openings can be collectively considered as the port through which fluids may be communicated between inner bore 112 and outer surface 84*c*.

Sleeve 82 is positioned to open and close port 88. For example, sleeve 82 can be placed in a position in annular chamber 86 to close port 88, wherein it spans across the port, and sleeve 82 can be placed in a position in the annular chamber wherein it is retracted from across the port, wherein port 88 is open to fluid flow therethrough. Sleeve 82 is moveable within chamber 86 between a closed port position and an opened port position. As noted above, sleeve 82 may be moved from the closed port position to the opened port position by generating a pressure differential between ends 82*a* and 82*b* of the sleeve. Chamber 86 is sized to accommodate this movement having an enlarged space on at least one side of the sleeve into which sleeve 82 can move.

An opening 90 is provided from bore 112 to chamber 86 where it is open to end 82*a* of the sleeve and another opening 92, that is separate and spaced from opening 90, is provided from bore 112 to chamber 86 where it is open to end 82*b* of the sleeve. Thus, pressure can be communicated from bore 112 to the ends of the sleeve through ports 90, 92 to create a pressure differential thereacross. In the illustrated sub, sleeve 82 is configured to open by moving up toward end 84*a*. Chamber 86 has an enlarged space 86*a* between port 88 and end 84*a* that is sized to accommodate sleeve 82 when it is moved from across port 88. Chamber 86 may further have an end wall 86*b* positioned between port 88 and end 84*a*. Opening 90, which communicates the opening pressure to chamber 86 is positioned between port 88 and end 84*b*. Opening 92, which acts as a vent from chamber 86 to prevent a pressure lock as the sleeve moves is positioned between port 88 and end 84*a*. As will be appreciated, if chamber 86 is closed except for opening 92, a pressure lock would occur if sleeve 82 was sought to be moved beyond opening 92. Thus, opening 92 is spaced sufficiently from port 88, for example a length corresponding to the length of the sleeve, to permit the sleeve to move through chamber 86 to open the port. In one embodiment, opening 92 is positioned well on the opposite side of space 86*a* from port 88, close to end wall 86*b*. When a pressure differential is established between opening 90 and opening 92, these pressures are communicated to ends 82*a*, 82*b* of the sleeve, respectively, and the sleeve will move to the lower pressure side.

Opening 90 and port 88 are spaced from opening 92 with a length L of inner facing wall 84*d* between them. The sleeve is positioned behind that length of the inner facing wall and access to the sleeve is prevented by wall 84*d* except through openings 90, 92 and port 88.

Seals 94 are provided between the walls defining chamber 86 and sleeve 82 to resist leakage between bore 112 and outer surface 84*c* past the sleeve when its closed and to resist fluid leakage between end 82*a* and end 82*b* to ensure that a pressure differential can be established therebetween. Since some fluid may be communicated to the sleeve through port 88 as well, as to port 90. Seals 94 may be positioned to also ensure that a pressure differential can be established between port 88 and end 82*b*.

Releasable locking devices may be employed to releasably hold the sleeve in a closed position and/or an open position. For example, shear pins, snap rings, collets, etc. may be employed between the sleeve and the wall. In the illustrated embodiment, shear pins 96*a* are installed between the sleeve and wall 84 to hold the sleeve in the closed position. The shear pins may be selected such that the sleeve only moves after a sufficient pressure differential is achieved across the sleeve. A collet/gland 96*b/c* is employed to hold the sleeve in the open position.

Figure 5A:
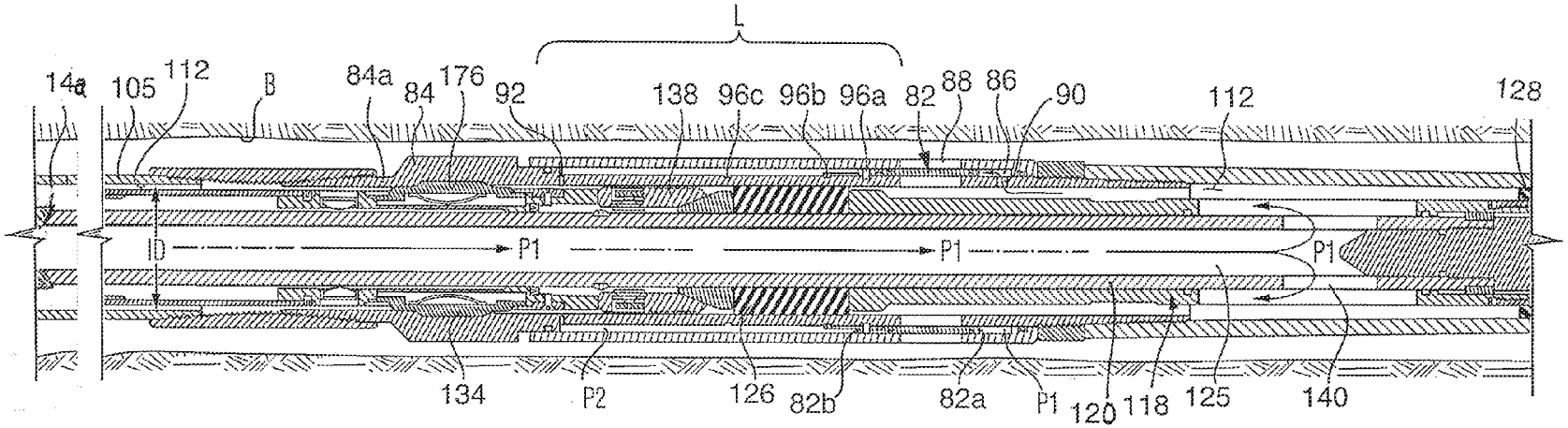
FIGS. 5A and 5B are sectional views along a long axis of a wellbore assembly including a straddle packer tool operating in a wellbore sliding sleeve valve.
Figure 5B:
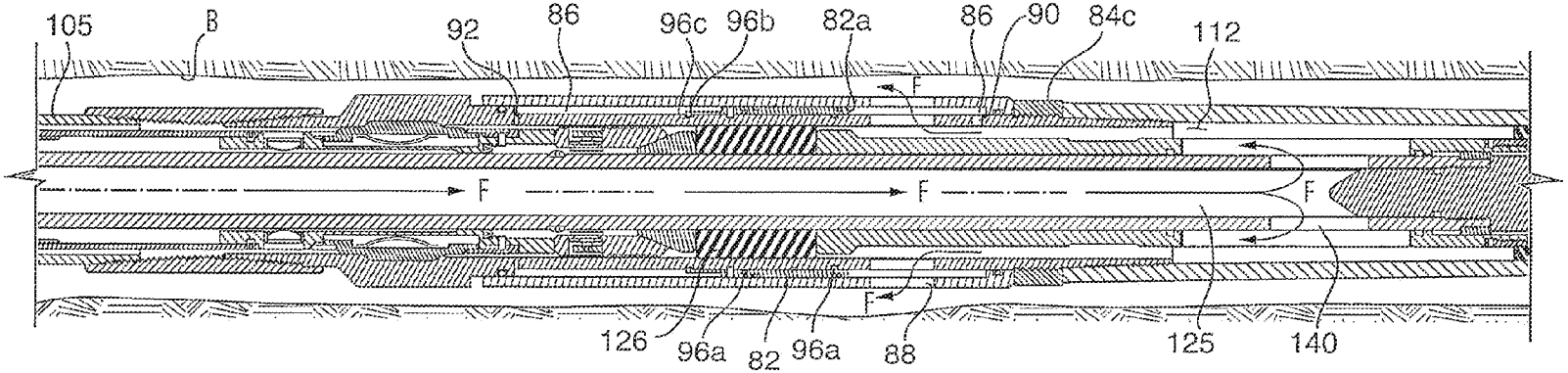

In use, as shown in FIGS. 5*a* and 5*b*, valve sub 80 may be connected into a liner string 105, such as of casing, liner, etc., and installed in a borehole B to provide access via ports 88 from its inner bore 112 to the formation through which the borehole is drilled. Valve sub 80 can accommodate and be operated by a straddle packer. FIG. 5, for example, show a straddle packer 118 similar to that disclosed hereinbefore in an operative position in sub 80. The packer includes a mandrel 120 with an inner bore 125 and a fluid port 140, a drag assembly 122 with drag blocks 134 and slips 138 and a packing element housing 124 with an upper packing element 126 and a lower packing element 128 positioned between the drag housing and a shoulder (not shown but similar to shoulder 20*d* of FIG. 1) on the mandrel. The packer can be set to expand element 126 and the lower element across the sub's inner diameter ID out into sealing engagement with inner facing wall 84*d*. To operate the sleeve of the sub to be hydraulically opened, packer 118 can be positioned with element 126 and the lower packing element 128 straddling the pressure communication path to one end 82*a* of the sleeve while the pressure communication path to opposite end 82*b* is outside of the area between elements. Using a straddle packer, therefore, a pressure differential can be readily established across the sleeve from end 82*a* to end 82*b* thereof and the sleeve can be moved as a piston.

As noted above, length L of inner facing surface 84*d* spans between port 88 and opening 92. This length is sufficient to accept sealing engagement of element 126 thereagainst, between openings 90 and 92 while the lower packing element is set on the opposite side of port 90, opposite the location of port 90. Port 90, being straddled by the packing elements, is in communication with bore 125 and port 140 and, thus, pressures can be communicated thereto and to end 82*a* (arrows P1). A pressure differential may be established across sleeve 82 by increasing the pressure P1 between the packing elements, which is communicated to end 82*a*, while the area about the packer and therefore the pressure at end 82*b*, remains at ambient P2. When a sufficient pressure differential is reached P1>P2 to shear pins 96*a*, the sleeve moves up toward end 84*a* from a closed position (FIG. 5A) to an open position (FIG. 5B). When the dogs of collet 96*b* reach gland 96*c*, the dogs will lock into the gland to hold the sleeve up in an opened position.

When sleeve 82 is opened, fluids (arrows F) can continue to be pumped through bore 125 and ports 140 and 88 to treat the formation accessed by borehole B.

Sub 80 may include a locator profile 176 in its inner facing surface 84*d* to facilitate location of the packer relative to port 88 and openings 90, 92. Locator profile 176 has an inner diameter greater than the normal ID of sub may be axially spaced from port 88 with considerations as to the compressed distance between upper packing element 126, the lower element and drag blocks 134 such that when the drag blocks are located in the associated locator profile and the packing elements are properly positioned in the sub. For example, element 126 is positioned to be set in length L between port 88 and opening 92 such that it properly isolates communication to end 82*a* from end 82*b*.

After the sleeve is opened and the formation is fluid treated, for example by fracing, various operations can be carried out. For example, while the packer elements remain set against inner facing surface 84*d*, the sleeve can be closed by pressuring up the annulus about the packer to generate a pressure at end 82*b* greater than at end 82*a*. Alternately, if it is desired to allow the formation to backflow right away, with the sleeve open, the packer can be unset and moved through the string. String 105 may include one or more further valve subs like sub 80 or other structures such as burst plugs, ports etc. that the packer can act upon as it moves up or down through the string.

While the valve sub selected to open with the sleeve moving up toward surface offers some benefits, it is to be understood that the valve sub could be installed upside down so that port 92 is closer to bottom hole. In such an orientation, however, the string below the valve must provide for or be opened to provide for displacement of the vented fluid from port 92 into the string below.

The processes can be conducted in horizontal or vertical wellbore orientations, in lined or open wells, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A straddle packer tool for setting against a constraining wall in which the straddle packer tool is positionable, the straddle packer tool comprising:

a drag assembly including a tubular body defining an inner bore extending along the length of the tubular body and an outer facing surface carrying a locking mechanism for locking a position of the drag assembly relative to the constraining wall;

a mandrel including a first end formed for connection to a tubular string and an opposite end, the mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly, the packing element being settable to expand the first annular packing element and the second annular packing element by compression between the drag assembly and the stop shoulder.

2. The straddle packer tool of claim 1 wherein the packer is configured to be settable by pulling the mandrel through the drag assembly to apply a compressive force to the packing element housing.

3. The straddle packer tool of claim 1 wherein the packer is tension settable from surface.

4. The straddle packer tool of claim 1 wherein the locking mechanism includes a drag block for resisting movement of the drag assembly along the constraining wall.

5. The straddle packer tool of claim 1 wherein the locking mechanism includes slips expandable to bite into the constraining wall.

6. The straddle packer tool of claim 1 further comprising a position indexing mechanism between the drag assembly and the mandrel configured to move the mandrel relative to the drag assembly between a set position, an unset position and an intermediate position wherein the packing element housing is maintained in an unsettable position.

7. The straddle packer tool of claim 6 wherein position indexing mechanism includes a slot and a key to guide movement of the mandrel through the inner bore.

8. The straddle packer tool of claim 7 wherein the slot is continuous about the circumference of the straddle packer tool.

9. The straddle packer tool of claim 6 wherein the position indexing mechanism is contained in a chamber and further comprising a pressure balancing system to balance pressure between the chamber and an outer surface of the straddle packer tool.

10. The straddle packer tool of claim 9 further comprising a screen to filter debris from entering the chamber.

11. The straddle packer tool of claim 1 further comprising a swivel connected at the first end to facilitate rotation of the mandrel about a long axis of the mandrel.

12. The straddle packer tool of claim 1 wherein the mandrel includes an outer surface and further comprising a bore extending through the mandrel from the first end toward the opposite end and a fluid delivery port opening from the bore onto the outer surface of the mandrel in a position between the first annular packing element and the second annular packing element.

13. A method for pressure isolating an area along a wellbore wall in a wellbore, the method comprising:

running into a wellbore with a straddle packer tool connected to a tubing string, the straddle packer tool including a drag assembly including a tubular body defining an inner bore extending along the length of the tubular body and an outer facing surface carrying a locking mechanism for locking a position of the drag assembly relative to the wellbore wall; a mandrel including a first end formed for connection to a tubular string and an opposite end, the tubular mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly;

positioning the straddle packer tool with the first annular packing element and the second annular packing element straddling the area of the wellbore; and pulling the tubing string into tension to expand the first annular packing element and the second annular packing element by compression between the drag assembly and the stop shoulder to seal against the wellbore wall and pressure isolate the area between the first annular packing element and the second annular packing element.

14. The method of claim 13 wherein positioning includes landing a portion of the drag assembly in a locator profile in the wellbore wall.

15. The method of claim 13 wherein positioning includes expanding slips to engage the wellbore wall to fully lock the drag assembly in a position in the wellbore.

16. The method of claim 13 wherein pulling the tubing string in tension pulls the mandrel through the drag assembly to compress and expand the first annular packing element and the second annular packing element.

17. The method of claim 13 further comprising positioning the straddle packer tool in an unsettable position.

18. The method of claim 13 further comprising cycling the straddle packer tool through set, unset and unsettable positions.

19. The method of claim 13 further comprising injecting fluid through the straddle packer tool to the area isolated by the packer elements.

20. The method of claim 13 further comprising affecting a component in the area by increasing fluid pressure in the area.

21. The method of claim 13 further comprising affecting a component in the area by increasing fluid pressure in the area, wherein affecting includes opening a sleeve valve in the area by creating a pressure differential across the sleeve valve.

22. The method of claim 21 wherein opening the sleeve valve includes movement of the sleeve valve toward surface.

23. The method of claim 22 wherein fluid is vented from movement of the sleeve valve into the wellbore uphole of the area isolated.

24. The method of claim 13 further comprising unsetting the straddle packer tool; repositioning the straddle packer tool with the first annular packing element and the second annular packing element straddling a second area of the wellbore; and pulling the tubing string into tension to expand the first annular packing element and the second annular packing element by compression between the drag assembly and the stop shoulder to seal against the wellbore wall and pressure isolate the second area between the first annular packing element and the second annular packing element.

25. The method of claim 24 wherein unsetting includes reconfiguring the straddle packer tool from a set position to an unset position and repositioning includes reconfiguring the straddle packer tool from the unset position to an unsettable position and pulling the tubing string into tension includes reconfiguring the straddle packer tool from the unsettable position, through a second unset position and then into the set position.

26. The method of claim 24 further comprising injecting fluid through the straddle packer tool to the second area.

27. A wellbore treatment assembly comprising:

a tubular string manipulatable from surface;

a swivel connected to the tubular string, the swivel having a first end and a second end and configured to permit rotation between its ends; and a straddle packer tool for setting against a constraining wall of the wellbore including: a drag assembly including a tubular body defining an inner bore extending along the length of the tubular body and an outer facing surface carrying a locking mechanism for locking a position of the drag assembly relative to the constraining wall; a mandrel including a first end connected for movement by the tubular string through the swivel and an opposite end, the tubular mandrel installed in and axially moveable through the inner bore of the drag assembly; and a packer including a packing element housing, a first annular packing element and a second annular packing element spaced from the first annular packing element, the packing element housing encircling and axially moveable along the mandrel and positioned between a stop shoulder on the mandrel and the drag assembly, the packer being settable to expand the first annular packing element and the second annular packing element by compression between the drag assembly and the stop shoulder.

28. The wellbore treatment assembly of claim 27 further comprising a valve sub in which the straddle packer tool is operated, the valve sub including a tubular wall, a port extending through the tubular wall, a sleeve installed in the tubular wall and moveable between a closed port position, wherein the sleeve closes the port and an open port position, wherein sleeve is retracted from the port; a first pressure communication path to a first end of the sleeve and a second pressure communication path to a second end of the sleeve, the first pressure communication path being axially spaced from the second pressure communication path such that a pressure differential can be established between the first end and the second end to move the sleeve.

29. The wellbore treatment assembly of claim 27 further comprising a bypass circulation valve positioned along the tubing string or with the swivel, the bypass circulation valve openable to permit circulation of fluid from the tubing string to an outer surface above the straddle packer tool.

30. The wellbore treatment assembly of claim 27 wherein the packer is configured to be settable by pulling the mandrel through the drag assembly to apply a compressive force to the packing element housing.

31. The wellbore treatment assembly of claim 27 wherein the packer is tension settable from surface.

32. The wellbore treatment assembly of claim 27 wherein the locking mechanism includes a drag block for resisting movement of the drag assembly along the constraining wall.

33. The wellbore treatment assembly of claim 27 wherein the locking mechanism includes slips expandable to bite into the constraining wall.

34. The wellbore treatment assembly of claim 27 further comprising a position indexing mechanism between the drag assembly and the mandrel configured to move the mandrel relative to the drag housing between a set position, an unset position and an intermediate position wherein the packing element housing is maintained in an unsettable position.

35. The wellbore treatment assembly of claim 34 wherein position indexing mechanism includes a slot and a key to guide movement of the mandrel through the inner bore.

36. The wellbore treatment assembly of claim 35 wherein the slot is continuous about the circumference of the straddle packer tool.

37. The wellbore treatment assembly of claim 34 wherein the position indexing mechanism is contained in a chamber and further comprising a pressure balancing system to balance pressure between the chamber and an outer surface of the straddle packer tool.

38. The wellbore treatment assembly of claim 37 further comprising a screen to filter debris from entering the chamber.

39. The wellbore treatment assembly of claim 27 further comprising a swivel connected at the first end to facilitate rotation of the mandrel about a long axis of the mandrel.

40. The wellbore treatment assembly of claim 27 wherein the mandrel includes an outer surface and further comprising a bore extending through the mandrel from the first end toward the opposite end and a fluid delivery port opening from the bore onto the outer surface of the mandrel in a position between the first annular packing element and the second annular packing element.

41. The wellbore treatment assembly of claim 27 wherein the constraining wall is defined by at least one wellbore valve sub, each of the at least one wellbore valve subs comprising:

a tubular wall including an upper end, a lower end, an inner facing surface defining an inner bore extending between the upper end and the lower end and an outer surface;

a port extending through the tubular wall providing fluid access between the inner bore and the outer surface;

a valve piston installed in the tubular wall and moveable between a closed port position, wherein the valve piston closes the port and an open port position, wherein the valve piston is retracted from the port;

a first pressure communication path through the tubular wall to a first end of the valve piston; and a second pressure communication path to a second end of the valve piston, the valve piston being moveable from the closed port position to the open port position by increasing the pressure in the first pressure communication path relative to the second pressure communication path to establish a pressure differential between the first end and the second end to move the valve piston toward a low pressure side.

42. The wellbore treatment assembly of claim 41 wherein the first pressure communication path and the second pressure communication path extend from the inner bore into communication with the valve piston.

43. The wellbore treatment assembly of claim 41 further comprising an annular chamber in the tubular wall, following the circumference of the tubular wall and encircling the inner bore and the valve piston is positioned in the annular chamber.

44. The wellbore treatment assembly of claim 41 wherein the inner bore includes a normal inner diameter and further comprising a locator profile formed as an annular groove formed in the inner facing wall and the locator profile having an inner diameter greater than the normal inner diameter.

45. The wellbore treatment assembly of claim 44 wherein the locator profile is positioned between the port and the upper end.

46. The wellbore treatment assembly of claim 41 wherein the locking mechanism includes a drag block for resisting movement of the drag assembly along the constraining wall and wherein the inner bore includes a normal inner diameter and further comprising a locator profile formed as an annular groove formed in the inner facing wall and the locator profile having an inner diameter greater than the normal inner diameter and sized to accept the drag block landed therein.

47. The wellbore treatment assembly of claim 41 wherein the locator profile is positioned between the port and the upper end.

48. The wellbore treatment assembly of claim 41 wherein the first pressure communication path is positioned between the port and the lower end; and the second pressure communication path is positioned between the port and the upper end, and the valve piston is configured to move upwardly toward the upper end when moving to the open port position.

49. The wellbore treatment assembly of claim 41 wherein the first pressure communication path is positioned between the port and the upper end; and the second pressure communication path is positioned between the port and the lower end, and the valve piston is configured to move downwardly toward the lower end when moving to the open port position.

50. The wellbore treatment assembly of claim 27 wherein the constraining wall is defined by at least one wellbore valve sub comprising:

a tubular wall including an upper end, a lower end, an inner facing surface defining an inner bore extending between the upper end and the lower end and an outer surface;

a port extending through the tubular wall providing fluid access between the inner bore and the outer surface;

an annular chamber in the tubular wall following the circumference of the tubular wall and encircling the inner bore;

a valve piston installed in the annular chamber and moveable between a closed port position, wherein the valve piston closes the port and an open port position, wherein the valve piston is retracted from the port;

a first pressure communication path through the tubular wall extending from the inner bore to the annular chamber to provide fluid communication between the inner bore and a first end of the valve piston; and a second pressure communication path extending from the inner bore to the annular chamber to provide fluid communication between the inner bore and a second end of the valve piston, the valve piston being moveable from the closed port position to the open port position by increasing the pressure in the first pressure communication path relative to the second pressure communication path to establish a pressure differential between the first end and the second end to move the valve piston toward a low pressure side.

51. The wellbore treatment assembly of claim 50 wherein the inner bore includes a normal inner diameter and further comprising a locator profile formed as an annular groove formed in the inner facing wall and the locator profile having an inner diameter greater than the normal inner diameter.

52. The wellbore treatment assembly of claim 51 wherein the locator profile is positioned between the port and the upper end.

53. The wellbore treatment assembly of claim 50 wherein the locking mechanism includes a drag block for resisting movement of the drag assembly along the constraining wall and wherein the inner bore includes a normal inner diameter and further comprising a locator profile formed as an annular groove formed in the inner facing surface and the locator profile having an inner diameter greater than the normal inner diameter and sized to accept the drag block landed therein.

54. The wellbore treatment assembly of claim 53 wherein the locator profile is positioned between the port and the upper end.

55. The wellbore treatment assembly of claim 50 wherein the first pressure communication path is positioned between the port and the lower end; and the second pressure communication path is positioned between the port and the upper end, and the valve piston is configured to move upwardly toward the upper end when moving to the open port position.

56. The wellbore treatment assembly of claim 50 wherein the first pressure communication path is positioned between the port and the upper end; and the second pressure communication path is positioned between the port and the lower end, and the valve piston is configured to move downwardly toward the lower end when moving to the open port position.

57. A method for opening a port in a wellbore valve sub, the wellbore valve sub comprising:

a tubular wall including an upper end, a lower end, an inner facing surface defining an inner bore extending between the upper end and the lower end and an outer surface;

the port extending through the tubular wall providing fluid access between the inner bore and the outer surface;

an annular chamber in the tubular wall following the circumference of the tubular wall and encircling the inner bore;

a valve piston installed in the annular chamber and moveable between a closed port position, wherein the valve piston closes the port and an open port position, wherein the valve piston is retracted from the port;

a first pressure communication path through the tubular wall extending from the inner bore to the annular chamber to provide fluid communication between the inner bore and a first end of the valve piston; and a second pressure communication path extending from the inner bore to the annular chamber to provide fluid communication between the inner bore and a second end of the valve piston, the valve piston being moveable from the closed port position to the open port position by increasing the pressure in the first pressure communication path relative to the second pressure communication path to establish a pressure differential between the first end and the second end to move the valve piston toward a low pressure side, the method comprising:

running into the wellbore valve sub with a straddle packer tool connected to a tubing string, the straddle packer tool including a drag assembly including a tubular body defining an inner bore extending along the length of the tubular body and an outer facing surface carrying a locking mechanism for locking a position of the drag assembly relative to the wellbore wall; a mandrel including a first end formed for connection to a tubular string and an opposite end, the tubular mandrel installed in and axially moveable through the inner bore of the drag assembly; and a packing element housing including a first annular packing element and a second annular packing element spaced from the first annular packing element, the packing element housing encircling and axially moveable along the mandrel and positioned between a stop shoulder on the mandrel and the drag assembly;

positioning the straddle packer tool with the first annular packing element and the second annular packing element creating a straddling area in which the first pressure communication path is positioned and the second pressure communication path is not positioned; and pulling the tubing string into tension to expand the first annular packing element and the second annular packing element by compression between the drag assembly and the stop shoulder to seal against the inner facing surface and pressure isolate the straddling area between the first annular packing element and the second annular packing element; and injecting fluid into the straddling area to increase the pressure in the first pressure communication path relative to the second pressure communication path and thereby move the valve piston and open the port.

58. The method of claim 57 wherein positioning includes landing a portion of the drag assembly in a locator profile in the inner facing surface.

59. The method of claim 57 wherein opening the port moves the valve piston toward surface.

60. The method of claim 59 wherein movement of the valve piston vents fluid from the annular chamber into the inner bore uphole of the straddling area.

61. The method of claim 57 wherein positioning includes expanding slips to engage the wellbore wall to fully lock the drag assembly in a position in the wellbore.

62. The method of claim 57 wherein pulling the tubing string in tension pulls the mandrel through the drag assembly to compress and expand the first annular packing element and the second annular packing element.

63. The method of claim 57 further comprising positioning the straddle packer tool in an unsettable position.

64. The method of claim 57 further comprising cycling the straddle packer tool through set, unset and unsettable positions.

* * * * *